US012736241B2

(12) United States Patent
Son et al.

(10) Patent No.: US 12,736,241 B2
(45) Date of Patent: Sep. 15, 2026

(54) AIR CONDITIONER HAVING POWER-SAVING FUNCTION AND AIR CONDITIONER CONTROL METHOD

(71) Applicant: SAMSUNG ELECTRONICS CO., LTD., Suwon-si (KR)

(72) Inventors: Kilsoo Son, Suwon-si (KR); Seokkyun Kim, Suwon-si (KR); Byoungok Ahn, Suwon-si (KR); Jeonghoon Kim, Suwon-si (KR); Taewoo Kim, Suwon-si (KR); Sangwoo Lee, Suwon-si (KR); Cheolmin Jo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 666 days.

(21) Appl. No.: 18/136,135

(22) Filed: Apr. 18, 2023

(65) Prior Publication Data

US 2023/0375202 A1 Nov. 23, 2023

Related U.S. Application Data

(63) Continuation of application No. PCT/KR2021/016166, filed on Nov. 8, 2021.

(30) Foreign Application Priority Data

Dec. 29, 2020 (KR) ..... 10-2020-0186742
Mar. 23, 2021 (KR) ..... 10-2021-0037125

(51) Int. Cl.
*F24F 11/46* (2018.01)
*F24F 11/52* (2018.01)
(Continued)

(52) U.S. Cl.
CPC ..... *F24F 11/46* (2018.01); *F24F 11/52* (2018.01); *F24F 11/61* (2018.01); *F24F 11/86* (2018.01); *F24F 2110/10* (2018.01)

(58) Field of Classification Search
CPC .. F24F 11/46; F24F 11/52; F24F 11/61; F24F 11/86; F24F 2110/10; F25B 13/00;
(Continued)

(56) References Cited

U.S. PATENT DOCUMENTS 5,797,729 A * 8/1998 Rafuse, Jr. ..... F04C 28/08 62/126
6,171,185 B1 * 1/2001 Jeong ..... F24F 11/79 237/2 A
(Continued)

FOREIGN PATENT DOCUMENTS

CN 105091241 A 11/2015
EP 1 443 280 B1 4/2007
(Continued)

OTHER PUBLICATIONS

Ho-Seon, KR20020075075A, Oct. 4, 2002. Translation retrieved on Jan. 21, 2026 from internet: <https://patents.google.com/patent/KR20020075075A/en?oq=KR+20020075075+A> (Year: 2002).*
(Continued)

*Primary Examiner* — Robert E Fennema
*Assistant Examiner* — Marzia T Monty
(74) *Attorney, Agent, or Firm* — STAAS & HALSEY LLP

(57) ABSTRACT

An air conditioner includes a compressor; an input unit to receive a target temperature and a power saving command including a power saving rate; an indoor temperature detection unit to obtain a room temperature; and a control unit to control so that the operating frequency of the compressor is determined based on the difference between the received target temperature and the obtained room temperature, the operating frequency is changed according to the power saving rate, and the compressor is driven with the changed operating frequency.

13 Claims, 13 Drawing Sheets

(51) Int. Cl.
*F24F 11/61* (2018.01)
*F24F 11/86* (2018.01)
*F24F 110/10* (2018.01)

(58) Field of Classification Search
CPC ..... F25B 2313/0233; F25B 2313/0314; F25B 2600/0253; F25B 2700/2104; F25B 2700/21152; F25B 49/022
See application file for complete search history.

(56) References Cited

U.S. PATENT DOCUMENTS

| | | | | |
|---|---|---|---|---|
| 9,890,968 | B2 | 2/2018 | Kinugasa | |
| 10,047,992 | B2 * | 8/2018 | Ushijima | F25B 49/022 |
| 2016/0339767 | A1 * | 11/2016 | Enomoto | B60H 1/00864 |
| 2019/0063769 | A1 * | 2/2019 | Hokanson | F24F 11/0001 |
| 2021/0025610 | A1 * | 1/2021 | Brahme | F24F 11/49 |

FOREIGN PATENT DOCUMENTS

| | | | |
|---|---|---|---|
| JP | 2007-218499 | | 8/2007 |
| JP | 2008-138958 | | 6/2008 |
| JP | 4468682 | | 5/2010 |
| JP | 6029460 | | 11/2016 |
| JP | 6094931 | | 3/2017 |
| JP | 6328411 | | 5/2018 |
| KR | 10-0286558 | | 4/2001 |
| KR | 10-0310151 | | 12/2001 |
| KR | 10-2002-0075074 | | 10/2002 |
| KR | 2002-0075075 | | 10/2002 |
| KR | 20020075075 | A * | 10/2002 |
| KR | 10-2003-0054549 | | 7/2003 |
| KR | 10-0390505 | | 7/2003 |
| KR | 20030054549 | A * | 7/2003 |
| KR | 10-2008-0034636 | | 4/2008 |
| KR | 10-2011-0048889 | | 5/2011 |
| KR | 10-2015-0144565 | | 12/2015 |
| KR | 10-2018-0060836 | | 6/2018 |
| KR | 10-1984923 | | 5/2019 |
| KR | 10-2019-0130763 | | 11/2019 |

OTHER PUBLICATIONS

Choi, KR20030054549A, Jul. 2, 2003. Translation retrieved on Jan. 21, 2026 from internet: <https://patents.google.com/patent/KR20030054549A/en?oq=KR20030054549A> (Year: 2003).*

New method for measuring field performance of variable refrigerant flow systems based on compressor set energy conservation. Article. [online]. Guohui Zhang, 2019[retrieved on May 2, 2026]. Retrieved from internet: <URL: https://www.sciencedirect.com/science/article/pii/S1359431118343503> (Year: 2019).*

International Search Report dated Mar. 4, 2022 issue in PCT Application No. PCT/KR2021/016166.

Office Action dated Apr. 22, 2026, issued in Korean Application No. 10-2021-0037125.

* cited by examiner

FIG.2B

| POWER-SAVING RATE | 40% | 60% | 80% | 100% | 120% |
|---|---|---|---|---|---|
| CORRESPONDENCE CONSTANT | 0.2~0.6 | 0.4~0.8 | 0.6~1.0 | 1 | 1.0~1.3 |

AIR CONDITIONER HAVING POWER-SAVING FUNCTION AND AIR CONDITIONER CONTROL METHOD

CROSS-REFERENCE TO RELATED APPLICATIONS

This application is a continuation application, under 35 U.S.C. § 111(a), of International Patent Application No. PCT/KR2021/016166, filed on Nov. 8, 2021, which claims the priority benefits of Korean Patent Application No. 10-2020-0186742, filed on Dec. 29, 2020, and Korean Patent Application No. 10-2021-0037125, filed on Mar. 23, 2021 in the Korean Patent and Trademark Office, the disclosures of which are hereby incorporated by reference in their entireties.

BACKGROUND

Field

The present disclosure relates to an air conditioner, and more particularly, to a method for controlling an air conditioner capable of performing an effective power-saving operation.

Description of the Related Art

For an air conditioner to perform a cooling function, energy needs to move from low pressure to high pressure, that is, from a low energy area to a high energy area in a reverse direction, and a compressor may be driven to enable refrigerant circulation in the reverse direction.

By a rotation motion of an internal motor provided in the compressor, refrigerants are compressed inside a compressor cylinder, and refrigerant circulation is performed in the system by a principle in which pressure rises from low pressure to high pressure.

By the operation, the air conditioner inevitably has the characteristics of high energy consumption.

Accordingly, the energy efficiency of an air conditioner is one of most important factors based on which a user selects the air conditioner, and to reduce energy consumption, research and development including the high efficiency of core element parts, such as a compressor, a heat exchanger, etc., are continuously conducted.

SUMMARY

An air conditioner according to an embodiment includes: a compressor; an inputter configured to receive a target temperature and a power-saving command including a power-saving rate; a room temperature detector configured to obtain a room temperature; and an integrated controller configured to set an operating frequency of the compressor based on a difference between the received target temperature and the obtained room temperature, change the operating frequency according to the received power-saving rate, and control the compressor to be driven at the changed operating frequency.

The integrated controller may be configured to set an absolute frequency based on the difference between the received target temperature and the obtained room temperature, and set the operating frequency by changing the absolute frequency based on a driving range of the compressor.

The power-saving command may include selecting a power-saving rate from among a plurality of preset power-saving rates, and the integrated controller may be configured to control the compressor by changing the operating frequency according to the selected power-saving rate.

The integrated controller may be configured to drive the compressor by applying the selected power-saving rate to the operating frequency until the driving of the compressor is interrupted or another power-saving command is input after a driving start time of the compressor.

The air conditioner according to an embodiment may further include a display, wherein the integrated controller may be configured to obtain the room temperature from the room temperature detector at preset time intervals from the driving start time of the compressor, and output, to the display, a guide message to guide a change of the power-saving command, based on a change of the difference between the received target temperature and the obtained room temperature, obtained after the driving start time.

The integrated controller may be configured to turn off the driving of the compressor based on the target temperature being higher than the obtained room temperature.

The integrated controller may be configured to set, based on a changed power-saving command input by the user through the inputter after the compressor is driven at the operating frequency, the operating frequency based on the changed power-saving command and a difference between the received target temperature and the obtained room temperature at a time at which the changed power-saving command is input.

The integrated controller may be configured to set, based on the an automatic power-saving command input by the user through the inputter, an optimization frequency based on a difference between a changed room temperature and the received target temperature, and drive the compressor at the set optimization frequency.

The air conditioner may further include a display, wherein the integrated controller may be configured to identify an accumulated driving time of the compressor, and output an error message to the display based on the accumulated driving time exceeding a preset time.

A method for controlling an air conditioner, according to an embodiment, includes: receiving a target temperature and a power-saving command including a power-saving rate; obtaining a room temperature; setting an operating frequency of a compressor based on a difference between the received target temperature and the obtained room temperature; changing the operating frequency according to the power-saving rate; and controlling the compressor to be driven at the changed operating frequency.

The method for controlling the air conditioner, according to an embodiment, may further include setting an absolute frequency based on the difference between the received target temperature and the obtained room temperature, wherein the setting of the operating frequency of the compressor may include setting the operating frequency by changing the absolute frequency based on a driving range of the compressor.

The power-saving command may include selecting a power-saving rate from among a plurality of preset power-saving rates, and the integrated controller may be configured to control the compressor by changing the operating frequency according to the selected power-saving rate.

The method for controlling the air conditioner, according to an embodiment, may further include driving the compressor by applying the selected power-saving rate to the operating frequency until the driving of the compressor is interrupted or another power-saving command is input after a driving start time of the compressor.

The obtaining of the room temperature may include obtaining the room temperature at preset time intervals from the driving start time of the compressor, and the method may further include outputting, to a display a guide message to guide a change of the power-saving command, based on a change of the difference between the received target temperature and the obtained room temperature, obtained after the driving start time.

The method for controlling the air conditioner, according to an embodiment, may further include turning off the driving of the compressor when the target temperature is higher than the room temperature.

The changing of the operating frequency according to the power-saving rate may include setting, when the user inputs a changed power-saving command through the inputter after the compressor is driven at the operating frequency, the operating frequency based on the changed power-saving command and a difference between the received target temperature and the obtained room temperature at a time at which the changed power-saving command is input.

The method for controlling the air conditioner, according to an embodiment, may include setting, when the user inputs an automatic power-saving command through the inputter, an optimization frequency based on a difference between a changed room temperature and the target temperature, and driving the compressor at the optimization frequency.

The method for controlling the air conditioner, according to an embodiment, may further include identifying an accumulated driving time of the compressor, and outputting an error message to the display when the accumulated driving time exceeds a preset time.

An air conditioner according to an embodiment includes: a compressor; an inputter configured to receive a target temperature and a power-saving command including a power-saving rate; a room temperature detector configured to obtain a room temperature; and a controller configured to set a reference driving pattern to drive at an absolute frequency based on a difference between the received target temperature and the obtained room temperature, change the reference driving pattern by using a driving range of the compressor and the power-saving rate, and control the compressor based on the changed reference driving pattern.

BRIEF DESCRIPTION OF THE DRAWINGS

FIG. 2B shows a plurality of power-saving rates and correspondence constants corresponding to the plurality of power-saving rates, respectively.

DETAILED DESCRIPTION

Figure 1:
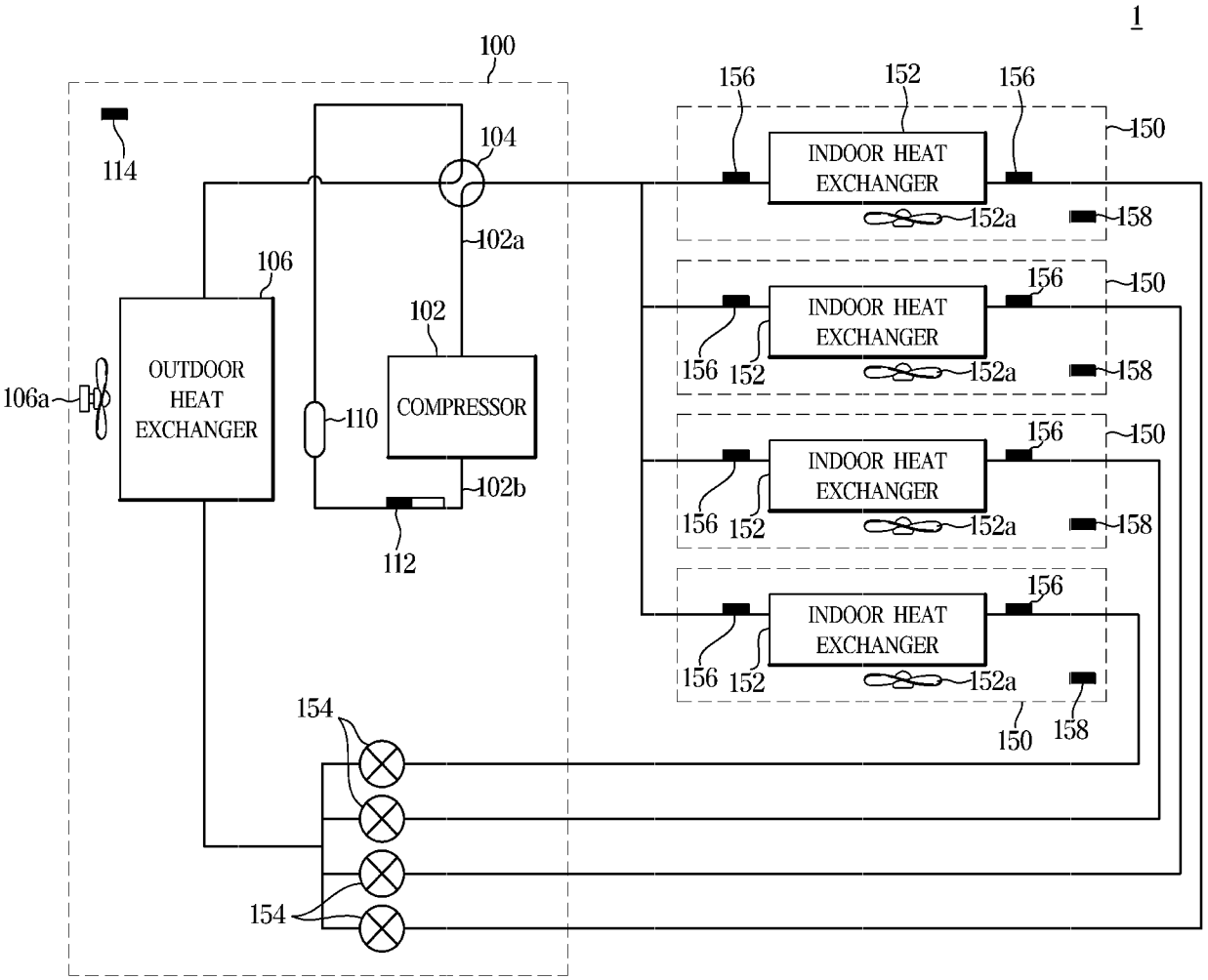
FIG. 1 shows a refrigerant cycle of an air conditioner according to an embodiment of the disclosure.

Like reference numerals will refer to like components throughout this specification. This specification does not describe all components of the embodiments, and general information in the technical field to which the disclosure belongs or overlapping information between the embodiments will not be described. As used herein, the terms "portion", "part, "module, "member" or "block" may be implemented as software or hardware, and according to embodiments, a plurality of "portions", "parts, "modules, "members" or "blocks" may be implemented as a single component, or a single "portion", "part, "module, "member" or "block" may include a plurality of components.

Throughout this specification, it will be understood that when a certain part is referred to as being "connected" to another part, it can be directly or indirectly connected to the other part. When a part is indirectly connected to another part, it may be connected to the other part through a wireless communication network.

Also, it will be understood that when a certain part "includes" a certain component, the part does not exclude another component but can further include another component, unless the context clearly dictates otherwise.

In the entire specification, it will also be understood that when an element is referred to as being "on" or "over" another element, it can be directly on the other element or intervening elements may also be present.

It will be understood that the terms first, second, etc., may be used only to distinguish one component from another, and these components should not be limited by these terms.

Also, it is to be understood that the singular forms "a," "an," and "the" include plural referents unless the context clearly dictates otherwise.

Reference numerals used in operations are provided for convenience of description, without describing the order of the operations, and the operations can be executed in a different order from the stated order unless a specific order is definitely specified in the context.

Hereinafter, an operation principle and embodiments of the disclosure will be described with reference to the accompanying drawings.

The disclosure provides an air conditioner capable of efficiently controlling a compressor by changing a number of revolutions of the compressor, set by a cooling load, in real time in correspondence to a user's command, and a method for controlling the air conditioner.

An air conditioner and a method for controlling the air conditioner, according to an embodiment, may efficiently control a compressor by changing a number of revolutions of the compressor, set by a cooling load, in real time in correspondence to a user's command.

FIG. 1 shows a refrigerant cycle of an air conditioner 1 according to an embodiment of the disclosure.

FIG. 1 shows a refrigerant cycle of the air conditioner 1 according to an embodiment of the disclosure. As shown in FIG. 1, the air conditioner 1 according to an embodiment of the disclosure may include at least one outdoor unit 100 and at least one indoor unit 150. Preferably, a plurality of indoor units 150 may be connected to a single outdoor unit 100.

The outdoor unit 100 may include a compressor 102, a 4-way valve 104, an outdoor heat exchanger 106, an electronic expansion valve 154, and an accumulator 110. The 4-way valve 104 may be connected to a discharge side 102*a* of the compressor 102, and the 4-way valve 104 may be controlled to cause a refrigerant discharged from the compressor 102 to flow to one side of the outdoor heat exchanger 106 during a cooling operation, and cause, during a heating operation, a refrigerant discharged from the compressor 102 to flow to one side of the indoor unit 150. The other side of the outdoor heat exchanger 106 may be connected to the indoor unit 150. An outdoor fan 106*a* may be installed around the outdoor heat exchanger 106. The accumulator 110 may be provided between an inlet side 102*b* of the compressor 102 and the 4-way valve 104. A compressor discharge temperature detector 112 may be installed at a discharge side refrigerant pipe of the compressor 102. At a certain area of the outdoor unit 100, an outside temperature detector 114 for detecting outside temperature may be installed. The compressor 102, which is a variable capacity type compressor, may change a capacity of the compressor 102 by changing an operating frequency to correspond to ability required by the indoor unit 150.

FIG. 1 shows the plurality of indoor units 150, wherein some of the indoor units 150 may be stand type indoor units, and some of the indoor units 150 may be wall-mounted type indoor units. The indoor units 150 may have the same refrigerant cycle structure.

That is, an indoor heat exchanger 152 may be provided in each indoor unit 150. An indoor fan 152*a* may be installed around the indoor heat exchanger 152.

Also, an indoor heat exchanger temperature detector 156 for detecting inlet temperature, midway temperature, and outlet temperature of the indoor heat exchanger 152 may be installed at a refrigerant pipe of both sides (an inlet and an outlet) of the indoor heat exchanger 152. Alternatively, it may be possible to detect only inlet temperature and midway temperature of the indoor heat exchanger 152 or detect only inlet temperature of the indoor heat exchanger. Also, a room temperature detector 158 for detecting room temperature may be installed at a certain area of the indoor unit 150.

Figure 2A:
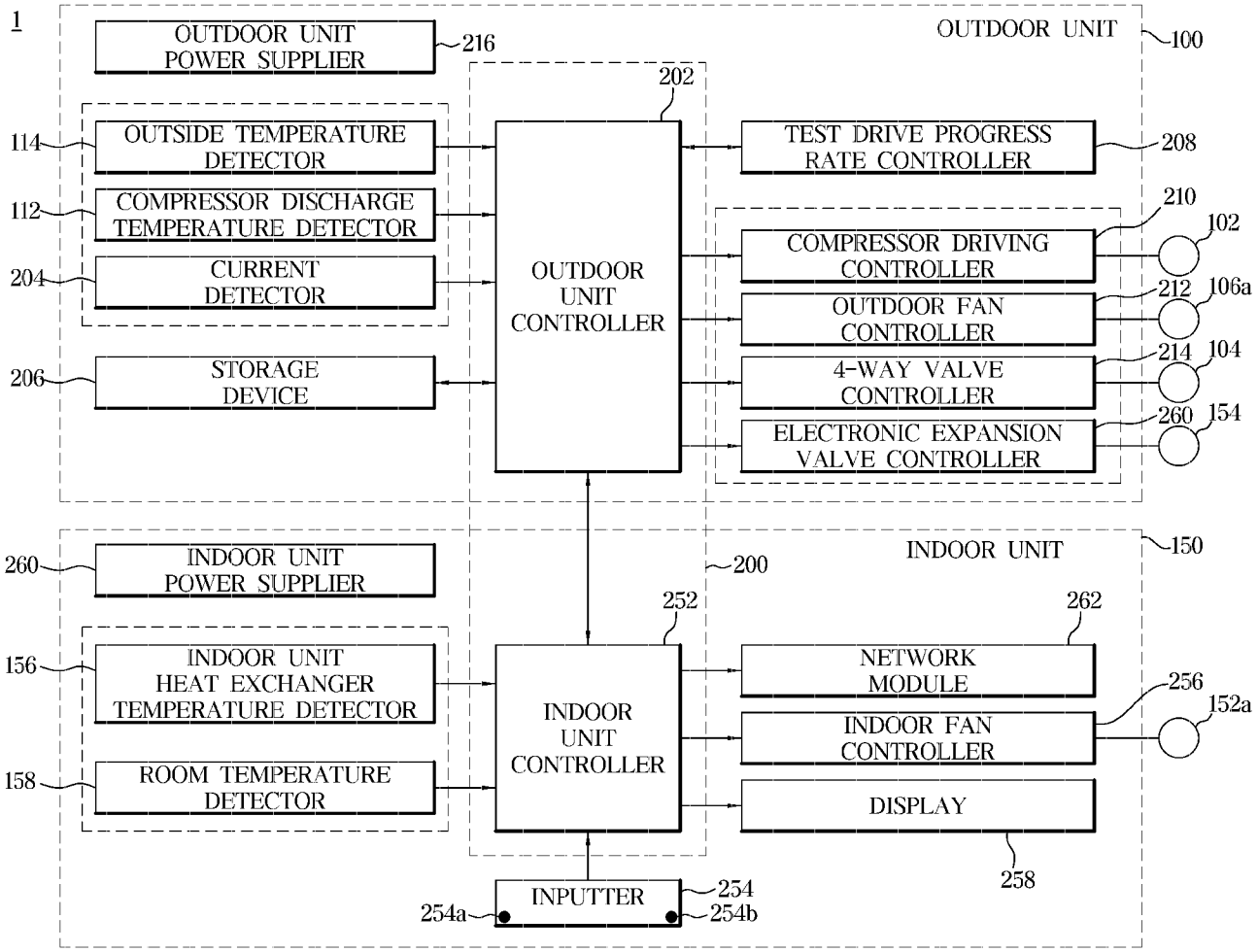
FIG. 2A is a block diagram of the air conditioner shown in FIG. 1.

FIG. 2A is a block diagram of the air conditioner 1 shown in FIG. 1.

In the outdoor unit 100, an outside temperature detector 114, a compressor discharge temperature detector 112, a current detector 204, a storage device 206, a compressor driving controller 210, an outdoor fan controller 212, a 4-way valve controller 214, and an electronic expansion valve controller 260 may be electrically connected to an outdoor unit controller 202 in such a way as to communicate with the outdoor unit controller 202.

Also, an outdoor unit power supplier 216 for supplying power to the outdoor unit 100 may be provided in the outdoor unit 100. The outside temperature detector 114 and the compressor discharge temperature detector 112 may be the same as those described above with reference to FIG. 1.

The current detector 204 may measure driving current of the outdoor unit 100. The storage device 206 may store data (a temperature detection value, a valve opening degree value, etc.) that is generated upon driving of the air conditioner 1, and store software, etc. required for driving the air conditioner 1. The compressor driving controller 210 may control driving of the compressor 102, the outdoor fan controller 212 may control driving (on/off) and a number of revolutions of the outdoor fan 106*a*, and the 4-way valve controller 214 may perform opening/closing, opening degree adjustment, etc. of the 4-way valve 104. The electronic expansion valve controller 260 may control an opening degree of the electronic expansion valve 154 in response to a control command from the outdoor unit controller 202.

In the indoor unit 150, the indoor heat exchanger temperature detector 156, the room temperature detector 158, an inputter 254, an indoor fan controller 256, and a display 258 may be electrically connected to an indoor unit controller 252 in such a way as to communicate with the indoor unit controller 252. Also, an indoor unit power supplier 260 for supplying power to the indoor unit 150 may be provided in the indoor unit 150. The indoor heat exchanger temperature detector 156 and the room temperature detector 158 may be the same as those described above with reference to FIG. 1.

The inputter 254 may enable a user or an installation personnel to generate a command for controlling the air conditioner 1 according to an embodiment of the disclosure, and the inputter 254 may include buttons or keys for generating basic driving control commands of the air conditioner 1. The inputter 254 may be provided in a main body of the indoor unit 150, according to embodiments.

Also, the inputter 254 may include a remote controller provided separately from the main body of the indoor unit 150, and a receiver for receiving a wireless signal from the remote controller, according to embodiments. In this case, the remote controller may include a plurality of buttons for a user input and a display for displaying control content.

The indoor fan controller 256 may control driving (on/off) and a number of revolutions of the indoor fan 152*a*.

Meanwhile, the inputter 254 may receive target temperature and a power-saving command.

The target temperature may be the user's desired room temperature.

The power-saving command may include a plurality of power-saving rates, which will be described below, and may be a command for reducing driving of the compressor.

The display 258 may display a driving state of the air conditioner 1, and display a guide message, a warning, etc. generated in a driving process of the air conditioner 1, and the display 258 may be provided in the indoor unit 150.

In the indoor unit 150 which is a stand type, the display 258 may be a Liquid Crystal Display (LCD) panel, and in the indoor unit 150 which is a wall-mounted type, the display 258 may be a light emitting device such as a Light Emitting diode (LED). Also, the display 258 may include a speaker.

A network module 262 for transmitting and receiving data by communicating with a server located at a remote place may be included in the indoor unit.

An integrated controller 200 may include an outdoor unit controller and an indoor unit controller.

The integrated controller 200 may obtain temperature from the room temperature detector provided in the indoor unit, and control the compressor driving controller to control driving of the compressor.

The integrated controller 200 may set an operating frequency of the compressor based on a difference between target temperature and room temperature.

Meanwhile, the above-mentioned operating frequency may be set by changing an absolute frequency set by a difference between room temperature and target temperature input by the user.

The absolute frequency may be a frequency required for the compressor such that the room temperature reaches the target temperature only based on a difference between the room temperature and the target temperature.

The operating frequency may be a frequency obtained by considering frequency variation from the absolute frequency according to intervention in various protection controls for protecting a system of the air conditioner 1 and minimum and maximum available frequency ranges in consideration of characteristics of the compressor.

The operating frequency may be a frequency obtained by applying a power-saving rate included in a power-saving command to the operating frequency.

That is, the integrated controller 200 may reflect a constant value corresponding to a power-saving rate of 40% to 120% included in the power-saving command to the operating frequency, thereby setting an operating frequency.

Meanwhile, the integrated controller 200 may control the compressor to be driven at the operating frequency.

Meanwhile, the power-saving command may include a plurality of power-saving rates.

Meanwhile, referring to FIGS. 2A and 2B, a plurality of power-saving rates that are included in a power-saving command are shown.

According to an embodiment, the user may select a power-saving rate within a range of 40% to 120% which is divided into five steps.

A capacity control of the compressor may be performed in accordance with the power-saving rate selected by the user, thereby reducing a consumption input of the compressor.

According to an embodiment, in a case in which the user selects a power-saving rate of 40%, a value of 0.2 to 0.6 may be applied to the operating frequency to set an operating frequency. The operation may be expressed by Equation below.

$$f_d = f_i \times C \quad \text{<Equation 1>}$$

In Equation 1, fd represents an operating frequency to which a power-saving rate is applied, fi represents an operating frequency. C represents a constant corresponding to the power-saving rate.

As shown in FIG. 2B, a constant corresponding to a power-saving rate may be selected by considering system characteristics, wherein a value corresponding to 40% may be selected from 0.2 to 0.6, a value corresponding to 60% may be selected from 0.4 to 0.8, a value corresponding to 80% may be selected from 0.6 to 1.0, and a value corresponding to 120% may be selected from 1.0 to 1.3.

The integrated controller 200 may change the operating frequency according to the power-saving rate selected from among the plurality of power-saving rates, thereby setting an operating frequency.

The integrate controller 200 may drive the compressor by applying the selected power-saving rate until driving of the compressor is interrupted or another power-saving command is input after a driving start time of the compressor.

An existing technique has suppressed a rise in frequency by reducing an upper limit of maximum available frequency at an operation start time.

Meanwhile, the disclosure may control a frequency in an entire driving area, not a specific section, by applying a method of directly controlling an operating frequency, instead of a method of lowering an upper limit of frequency of a compressor.

Accordingly, the air conditioner 1 may be driven by applying the power-saving rate to the operating frequency until driving of the compressor is interrupted or another power-saving command is input after the driving start time. A detailed description about this will be described below.

The integrated controller 200 may obtain the room temperature from the room temperature detector at preset time intervals from the driving start time of the compressor, and output, to the display, a guide message for guiding a change of the power-saving command based on a change of a difference between the target temperature and room temperature obtained after the driving start time.

The integrated controller 200 may induce a command for decreasing the power-saving rate based on a great difference between the room temperature and the target temperature, and induce a command for increasing the power-saving rate based on a small difference between the room temperature and the target temperature, while driving the compressor at the operating frequency to which the power-saving rate has been applied.

The controller may turn off driving of the compressor in a case in which the target temperature is higher than the room temperature.

In a case in which the user inputs a changed power-saving command through the inputter after the compressor is driven at the operating frequency, the controller may set an operating frequency based on the changed power-saving command and a difference between the target temperature and room temperature at a time at which the changed power-saving command is input.

That is, the integrated controller 200 may receive a power-saving command from the user while driving the compressor, and control the air conditioner 1 based on a situation at a time at which the power-saving command is input.

In a case in which the user inputs an automatic power-saving command through the inputter, the integrated controller 200 may set an optimization frequency based on a difference between a changed room temperature and the target temperature.

The automatic power-saving command may be a command for performing an operation providing an operation optimized for the compressor based on data obtained through learning by the integrated controller 200.

The optimization frequency may be a frequency for minimizing power consumption of the compressor in consideration of a difference between target temperature and room temperature.

The integrated controller 200 may identify an accumulated driving time of the compressor, and output an error message to the display in a case in which the accumulated driving time exceeds a preset time.

That is, in a case in which the compressor is driven excessively for a longer time than the preset time, the integrated controller 200 may identify that a control of the air conditioner 1 is improper, and output an error message.

The indoor unit 100 and the outdoor unit 150 shown in FIGS. 1 and 2 may perform interactive bidirectional communication, and the plurality of indoor units 150 may also perform interactive bidirectional communication. Through the bidirectional communication, the outdoor unit 100 and the plurality of indoor units 150 may transmit/receive various information generated during driving to/from each other.

At least one component may be added or omitted to correspond to performance of the components of the air conditioner 1 shown in FIG. 2A. Also, it will be easily understood by one of ordinary skill in the art that relative positions of the components may change to correspond to the performance or structure of the system.

Meanwhile, the components shown in FIG. 2A may be software components and/or hardware components, such as a Field Programmable Gate Array (FPGA) and an Application Specific Integrated Circuit (ASIC).

Figure 3:
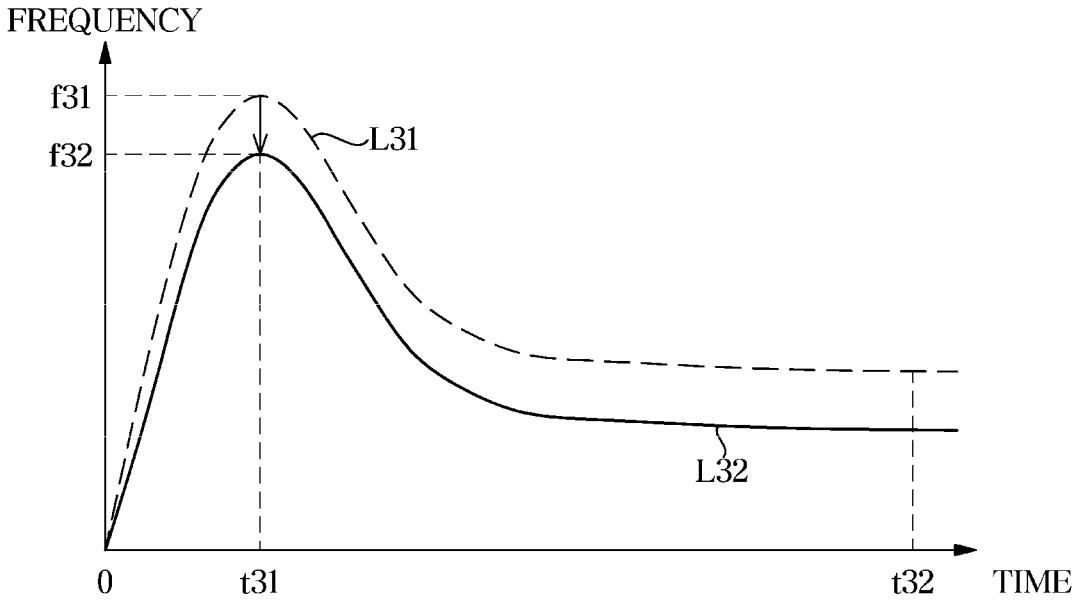
FIG. 3 is a view for describing an operation for changing an operating frequency of a compressor based on a power-saving command, according to an embodiment.

FIG. 3 is a view for describing an operation for changing an operating frequency of a compressor based on a power-saving command, according to an embodiment.

Referring to FIG. 3, L31 is a graph showing an operating frequency of the compressor with respect to time during normal driving of the compressor, and L32 shows an operating frequency of the compressor in a case in which a user inputs a power-saving command.

That is, L31 may be a normal reference driving pattern of the compressor, and L32 may be a changed reference driving pattern to which a power-saving rate has been applied.

The existing technique has suppressed a rise in frequency by reducing an upper limit of maximum available frequency of a compressor at an operation start time.

Because a rise in frequency is suppressed in a condition of a high cooling load during a cooling operation by reducing a maximum upper limit of target frequency of a compressor, an effect in which a consumption input of the compressor is lowered in an initial operation section may be obtained.

However, in the existing technique, a user may feel insufficient cooling due to low initial cooling power.

Also, because there is no difference from existing cooling during a major operation section in which a frequency of a compressor is lower than a maximum frequency, an actual power-saving effect is significantly low.

The disclosure may apply a method of directly controlling an indication frequency, instead of the method of reducing the upper limit of maximum frequency.

That is, the integrated controller 200 may reduce a maximum available frequency of the compressor to an operating frequency suitable for the compressor according to a power-saving command input by a user.

For example, at a time t31 at which an existing maximum frequency of the compressor is f31, the integrated controller 200 may control the compressor to be driven at a frequency of f32 by applying a power-saving rate.

The control may be a method for controlling the compressor in an entire frequency section, not a preset frequency section.

That is, the disclosure may perform driving of L32 by changing an operation of L31 corresponding to the existing maximum frequency of the compressor by a preset rate, as long as there is no special situation in which a user inputs another power-saving command until an end time t32 of driving of the compressor from a start time of the driving.

Meanwhile, the operation described above with reference to FIG. 3 may be an embodiment of the disclosure for changing a frequency of the compressor based on a power-saving command input by a user, and an embodiment of an operation for changing an operating frequency of the compressor based on a power-saving command input by a user is not limited.

Figure 4A:
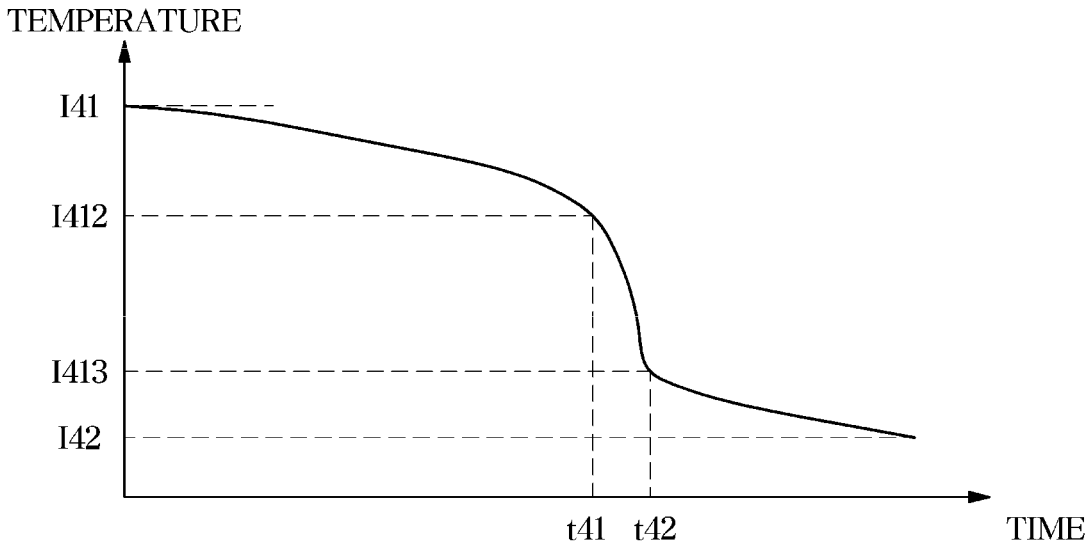
FIGS. 4A and 4B are views for describing an operation for guiding a power-saving command based on a difference between setting temperature input by a user and room temperature.
Figure 4B:
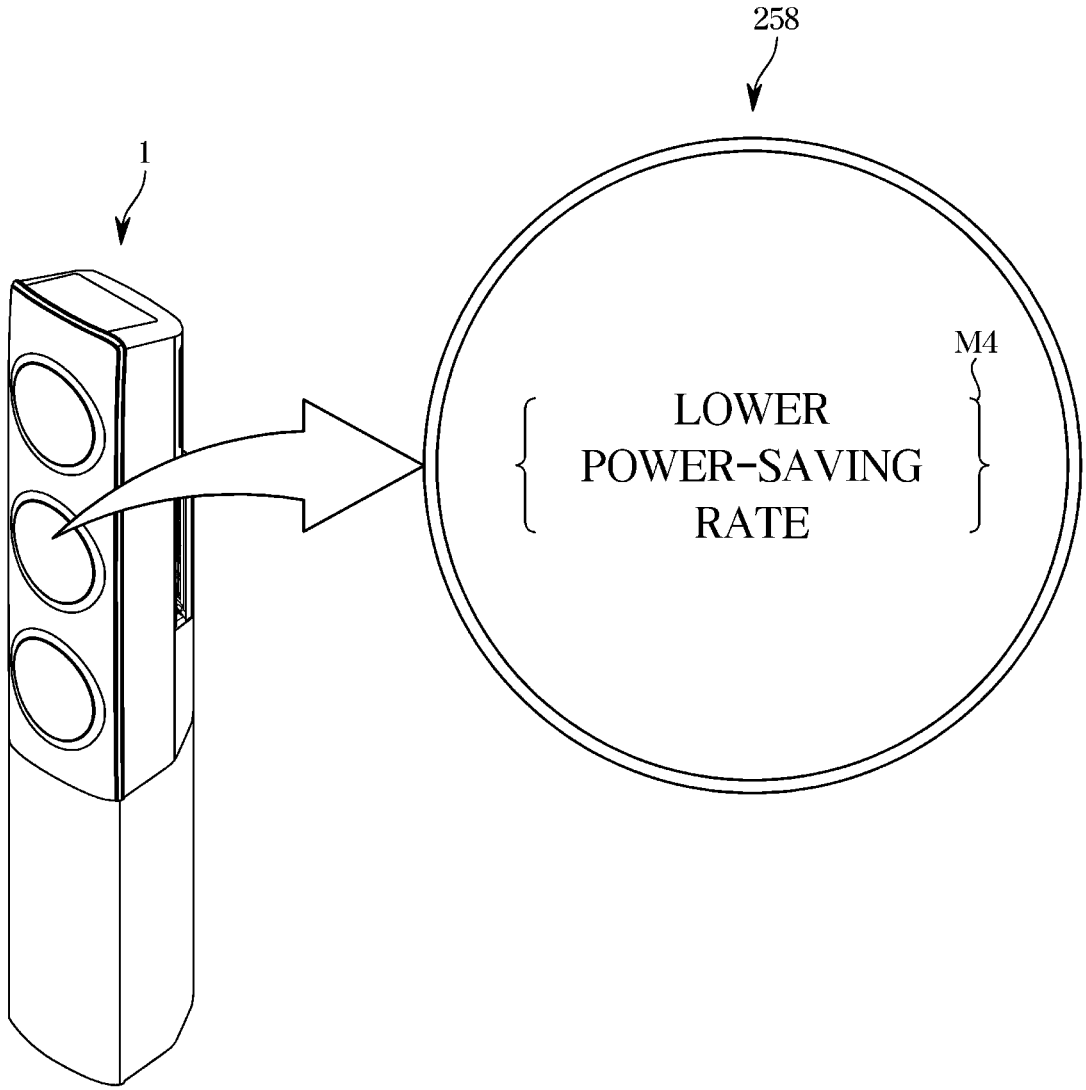

FIGS. 4A and 4B are views for describing an operation for guiding a power-saving command based on a difference between setting temperature input by a user and room temperature.

Referring to FIGS. 4A and 4B, a change of room temperature where the air conditioner 1 is provided and desired temperature I42 input by a user are shown.

The integrated controller 200 may obtain the room temperature from the room temperature detector at preset time intervals from a driving start time of the compressor.

The preset time interval may change according to the user, and FIG. 4A shows an operation in which the air conditioner 1 obtains room temperature at t41 and t42.

The integrated controller 200 may guide a change of a power-saving command based on a change of a difference between target temperature and room temperature obtained after the driving start time.

For example, in a case in which room temperature at a driving start time of the air conditioner 1 is I41 and desired temperature input by the user is I42, the integrated controller 200 may set an operating frequency for driving the compressor based on a temperature difference.

The user may input a power-saving command at a time which he/she drives the air conditioner 1. Referring to FIG. 4A, a case of inputting a power-saving rate of 80% is described.

In the case in which the user inputs the power-saving rate of 80% and starts cooling, the integrated controller 200 may again obtain room temperature at a time t41.

At the time t41, the room temperature may be measured as I412. In this case, it may be identified that a time has elapsed, a difference from I42 has been reduced, and cooling is properly performed.

As such, in the case in which cooling is properly performed, the controller may output no guide message.

However, in a case in which a cooling time continues to reach a time t42, room temperature may be measured as I413.

Also, I413 may make little difference from the target temperature I42 input by the user.

Accordingly, in this case, the integrated controller 200 may output a message for guiding the user to lower a power-saving step In summary, because cooling has been properly performed until t41 after the air conditioner 1 starts being driven, the integrated controller 200 may output no guide message, while because cooling has been relatively excessively performed from t41 to t42, the integrated controller 200 may output a guide message for guiding a change of a power-saving command to the display, as shown in FIG. 4B.

According to an embodiment, the user may recognize the guide message, and lower the power-saving rate of 80% to 60%, and the compressor may be driven at a lower operating frequency to perform cooling.

As described above, the display 258 may display a driving state of the air conditioner 1 and also display a guide message, a warning, etc. generated during a driving process of the air conditioner 1. The display 258 may be provided in the indoor unit 150.

Meanwhile, the operation described above with reference to FIGS. 4A and 4B may be an embodiment of the disclosure, and an operation for guiding a power-saving command based on a difference between room temperature and target temperature input by a user or a form of an output message M4 is not limited.

Figure 5:
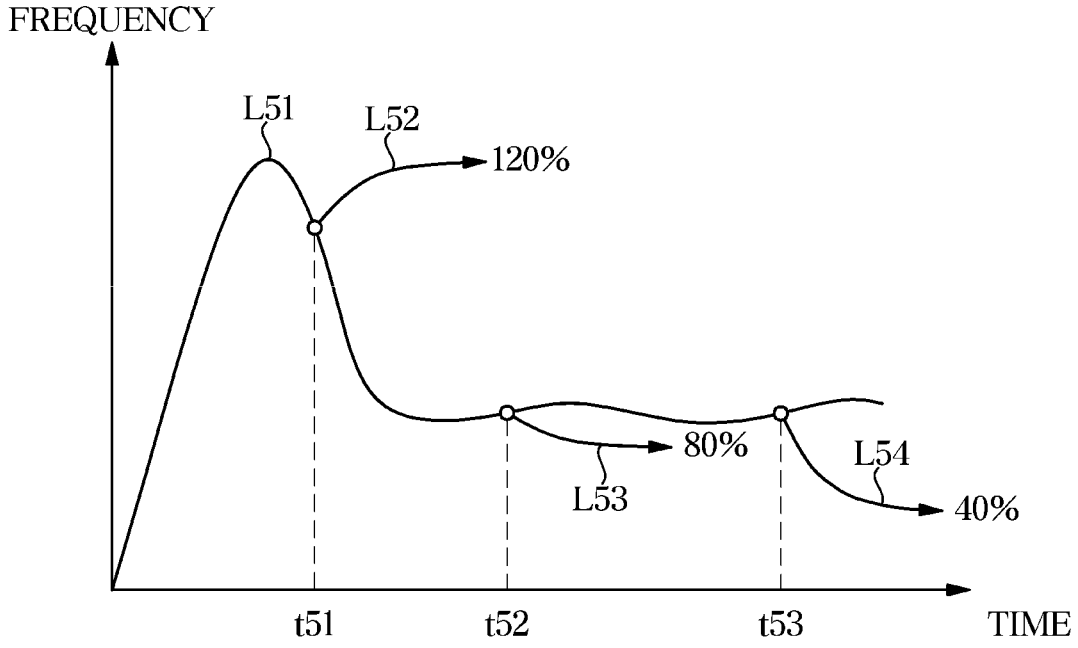
FIG. 5 is a view for describing an operation for changing an operating frequency of a compressor according to a time at which a user's power-saving command is input, according to an embodiment.

FIG. 5 is a view for describing an operation for changing an operating frequency of a compressor according to a time at which a power-saving command from a user is input, according to an embodiment.

Referring to FIG. 5, the integrated controller 200 may drive the compressor at an operating frequency, and then, in a case in which the user inputs a changed power-saving command through the inputter, the integrated controller 200 may set an operating frequency based on the changed power-saving command and a difference between target temperature and room temperature at a time at which the changed power-saving command is input.

The integrated controller 200 may directly control an indication frequency based on the power-saving command from the user.

Also, through the operation, a frequency control in an entire driving area in which the compressor operates may be possible.

Accordingly, the integrated controller 200 may perform a power-saving operation of a user's desired level at the user's desired time.

Referring to FIG. 5, L51 is a graph showing a frequency of the compressor that performs no power-saving control.

In a case in which the user inputs a power-saving command corresponding to a power-saving rate of 120% at a time t51 while the compressor performs an operation based on temperature at a time at which the compressor is driven and a power-saving command from the user, the compressor may be driven at a frequency of L52.

In this case, the compressor may operate at a higher frequency than previously to provide a strong cooling operation.

Meanwhile, in a case in which the user inputs a power-saving command corresponding to a power-saving rate of 80% at a time t52, the compressor may be driven at a frequency of L53.

In this case, the compressor may be driven at a lower frequency than a normal frequency of the compressor to provide a power-saving operation.

Meanwhile, in a case in which the user inputs a power-saving command corresponding to a power-saving rate of 40% at a time t53, the compressor may be driven at a frequency of L54.

In this case, the compressor may be driven at a lower frequency than that of the compressor at the time t53 to provide a power-saving operation.

That is, as shown in FIG. 5, a power-saving control may be possible according to a power-saving command input by a user even in a low load area in which the compressor operates at a low frequency due to a small cooling load.

Also, as described above, by changing a calculated indication frequency by considering a cooling load that is a difference between room temperature and target temperature input by a user, the compressor may be actively controlled in accordance with a cooling load at a control time.

Meanwhile, the operation of the disclosure, described above with reference to FIG. 5, may be an embodiment of the disclosure, and an embodiment of the disclosure for changing a power-saving control according to a time at which a user inputs a power-saving command is not limited.

Figure 6:
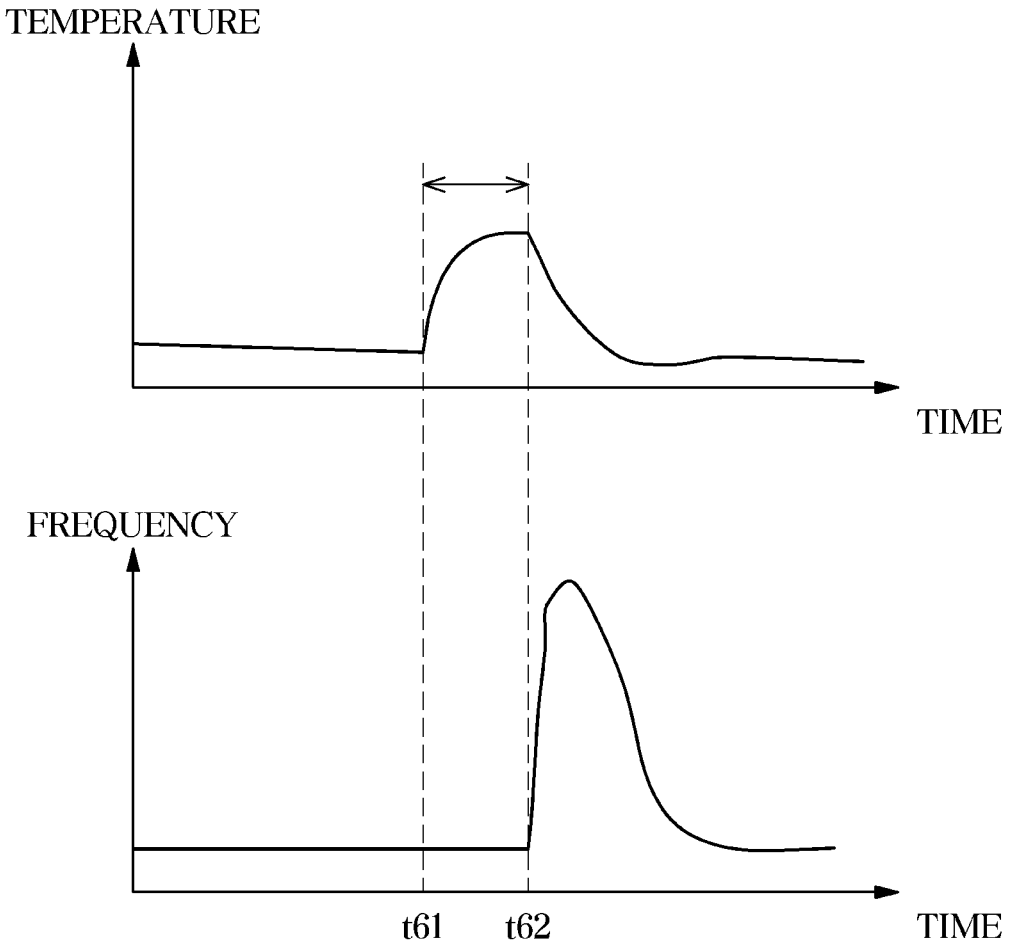
FIG. 6 is a view for describing a change of a power-saving command according to a change of room temperature and a corresponding operation of a compressor, according to an embodiment.

FIG. 6 is a view for describing a change of a power-saving command according to a change of room temperature and a corresponding operation of a compressor, according to an embodiment.

Referring to FIG. 6, a difference between target temperature input by a user and room temperature may be small until a time t61.

FIG. 6 shows an operation in which a user inputs a power-saving command including a power-saving rate of 40%.

In a case in which a difference between target temperature and room temperature is maintained constant, the integrated controller 200 may response by an operating frequency variable control.

FIG. 6 shows a situation in which room temperature rises rapidly at a time t62.

At a time t62, in a case in which a number of people residing in a residence space increases, room temperature may rise rapidly.

The integrated controller 200 may change an operating frequency of the compressor by receiving a user's command.

The user may input a power-saving rate of 120% at a time t62 according to the rapid rise of temperature.

In this case, the compressor may be driven at 120% of the operating frequency. The air conditioner 1 may perform strong cooling to reduce the room temperature.

That is, in a case in which a load amount increases temporarily rapidly, as shown in FIG. 6, room temperature may increase in a condition in which a power-saving rate is maintained at 40%.

Also, in a case in which the user selects a power-saving command including a power-saving rate of 120%, the room temperature may be reduced within a short time by increasing a number of revolutions of the compressor and a number of revolutions of the indoor fan by a preset level or more compared to a current number of revolutions.

Meanwhile, FIG. 6 shows a change of an operating frequency according to a temporary rise of temperature. However, the room temperature may change rapidly according to a decrease of temperature or another reason and the operating frequency of the compressor may change according to a change of a power-saving command from a user.

Figure 7A:
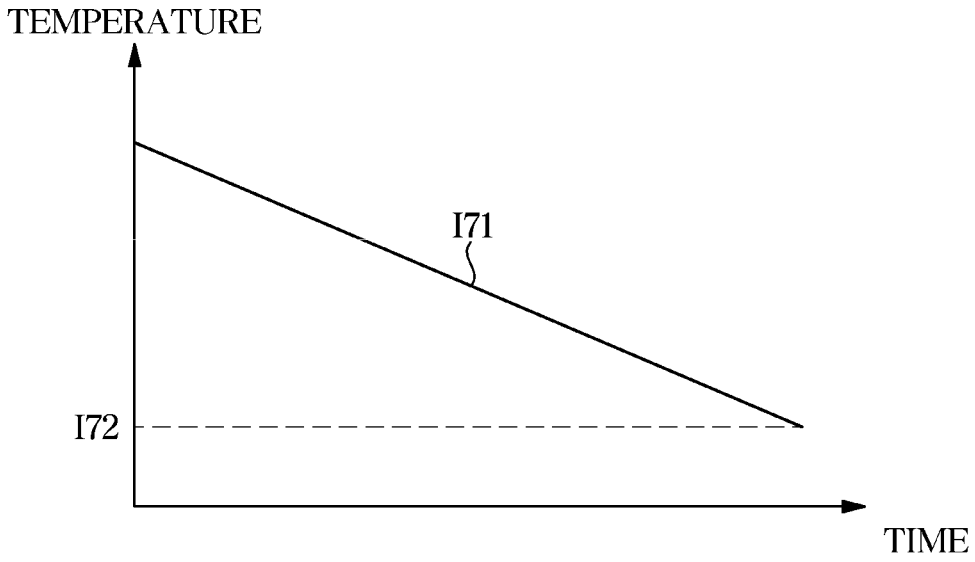
FIGS. 7A and 7B show views for describing an operation of an air conditioner in a case in which an automatic power-saving command is input, according to an embodiment.
Figure 7B:
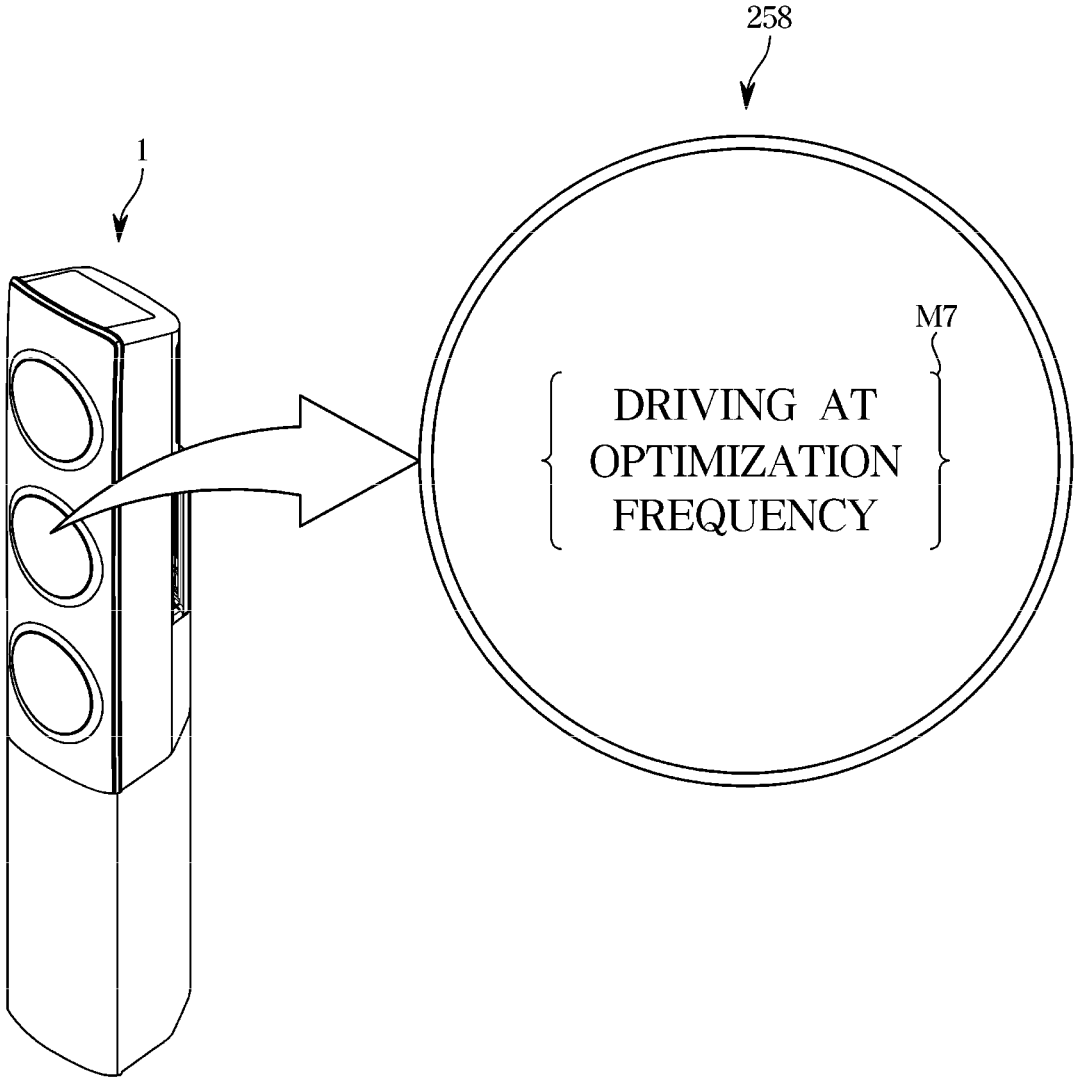

FIGS. 7A and 7B show views for describing an operation of the air conditioner 1 in a case in which an automatic power-saving command is input, according to an embodiment.

FIG. 7A shows an embodiment in a case in which a user inputs an automatic power-saving command.

In a case in which a user inputs an automatic power-saving command through the inputter, the integrated controller 200 may set an optimization frequency based on a difference between a changed room temperature and the target temperature.

A power-saving command may enable a user to input a power-saving rate, as described above, whereas an automatic power-saving command may cause the integrated controller 200 to set a most appropriate operating frequency of the compressor by considering a difference between current room temperature and a target temperature from a user.

A frequency of the compressor, set by the integrated controller 200 in correspondence to the automatic power-saving command, may be defined as the optimization frequency.

Referring to FIG. 7B, in the case in which the user inputs the automatic power-saving command, the integrated controller 200 may output a message M7 informing driving at a frequency corresponding to the automatic power-saving command to the display.

Referring to FIG. 7A, the integrated controller 200 may drive the compressor at an optimization frequency based on a difference between room temperature and target temperature I71 input by a user.

Meanwhile, the integrated controller 200 may use preset reference data or learned data to set the optimization frequency.

The learned data may have been learned through machine learning, etc. or received from an external server.

Also, because the integrated controller 200 drives the compressor at the optimization frequency, the compressor may be driven with maximized efficiency, and room temperature may be gradually lowered.

The embodiment according to the automatic power-saving command mentioned above with reference to FIGS. 7A and 7B may be an embodiment of the disclosure, and an operation for setting an optimization frequency according to learning of the integrated controller 200 is not limited. A learning operation and method of the integrated controller 200 are not limited.

Figure 8:
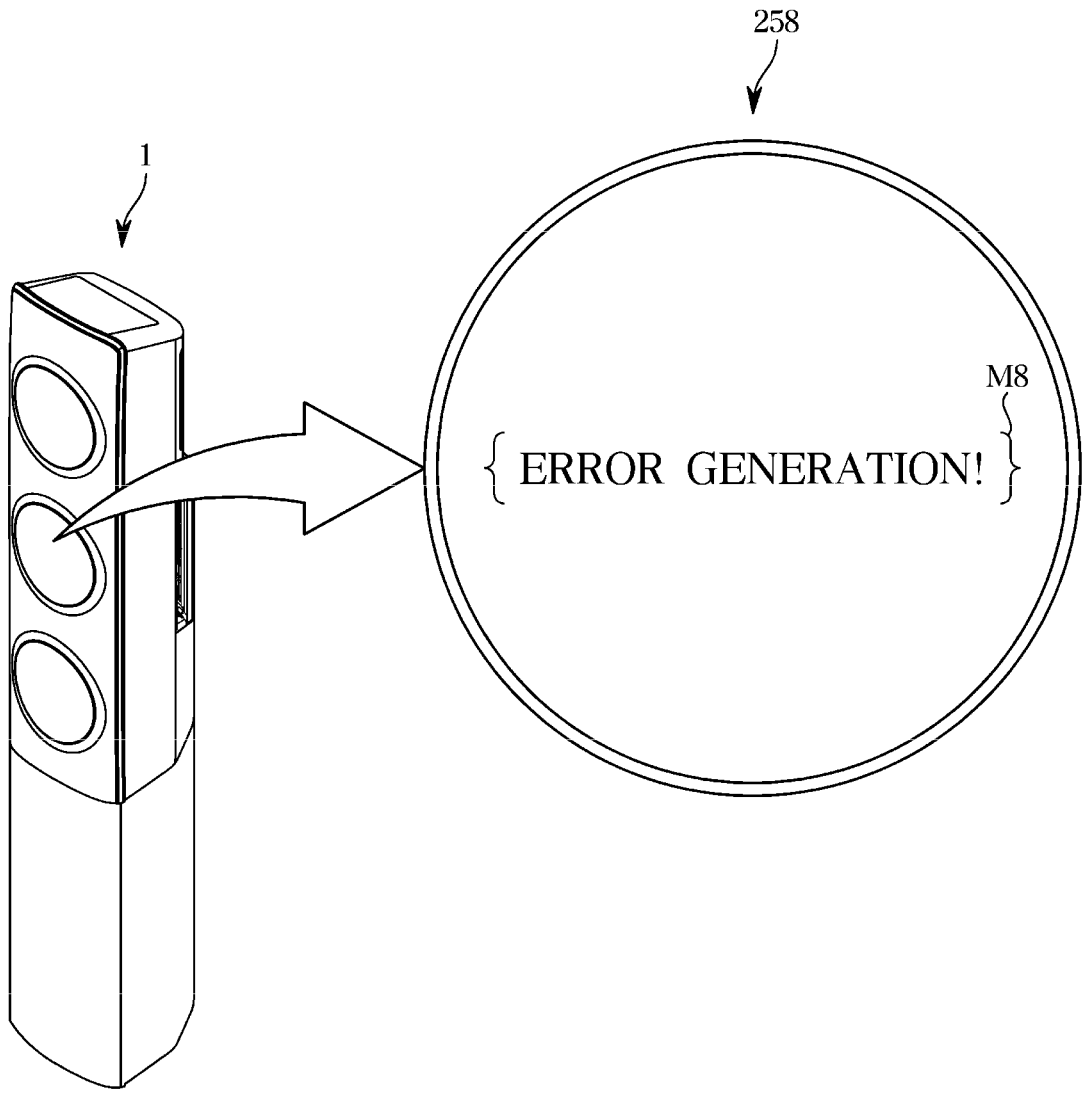
FIG. 8 is a view for describing an operation in which an error message is output according to elapse of a driving time of a compressor, according to an embodiment.

FIG. 8 is a view for describing an operation in which an error message is output according to elapse of a driving time of a compressor, according to an embodiment.

The integrated controller 200 may set an accumulated driving time of the compressor, and in a case in which the accumulated driving time exceeds a preset time, the integrated controller 200 may output an error message to the display.

In FIG. 8, a case of outputting an error message M8 such as "error generation" is shown.

In the case in which the accumulated driving time of the compressor exceeds the preset time, the integrated controller 200 may identify that a wrong connection has been made in the indoor unit or the outdoor unit.

More specifically, the accumulated driving time of the compressor, based on which a wrong connection is identified, may be set to a time of 1 minute to 3 minutes.

Meanwhile, the integrated controller 200 may identify refrigerant leakage or valve clogging, instead of a wrong connection, according to an accumulated driving time of the compressor.

More specifically, in a case in which an accumulated driving time of the compressor is a time of 4 minutes to 8 minutes, the integrated controller 200 may identify refrigerant leakage or valve clogging and output the error message M8 to the display.

Meanwhile, an embodiment in which the integrated controller 200 identifies an error of the air conditioner 1 based on an accumulated driving time of the compressor is not limited, and a form of a message that is output to the display by the integrated controller 200 is also not limited.

Figure 9:
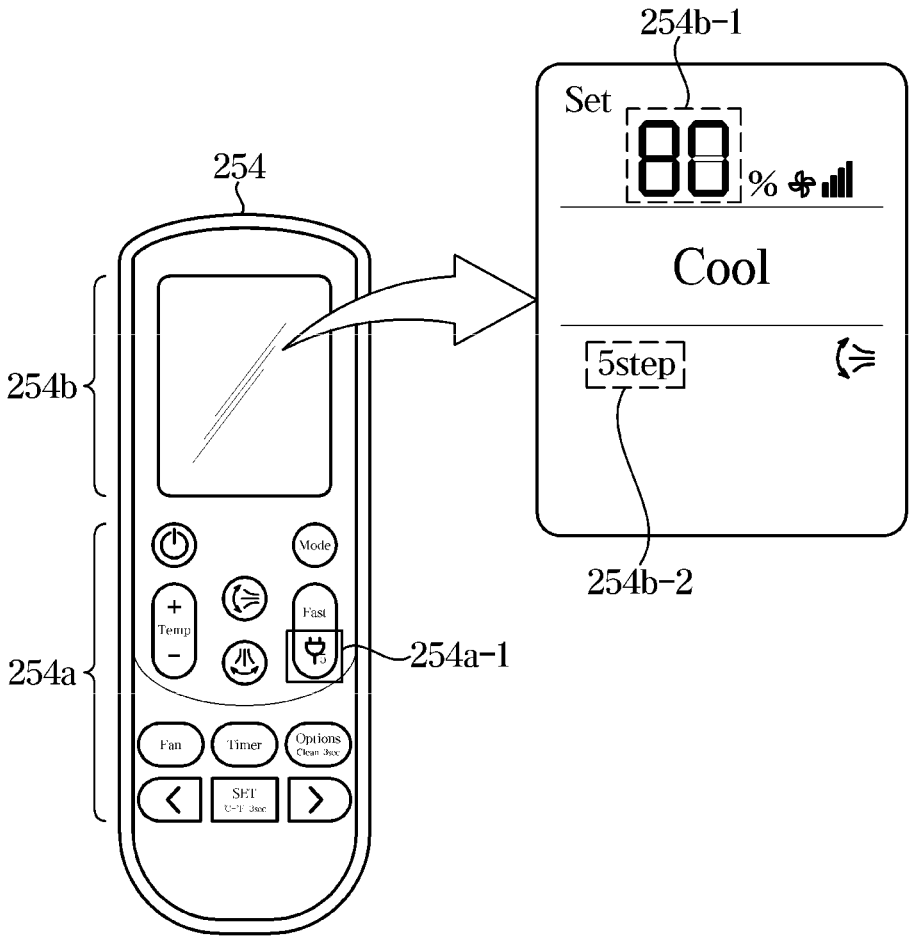
FIG. 9 is a view for describing a case in which an inputter according to an embodiment receives a power-saving command from a user.

FIG. 9 is a view for describing a case in which the inputter 254 according to an embodiment receives a power-saving command from a user.

Referring to FIG. 9, the inputter 254 may be provided as a remote controller, as described above, and in this case, the inputter 254 may include a plurality of buttons 254*a* for a user input, and a display 254*b* for displaying control content. Particularly, the inputter 254 may include a power-saving command input button 254*a*-1 for receiving a power-saving command.

Accordingly, a user may input a power-saving command by pressing the power-saving command input button 254*a*-1.

In a case in which the inputter 254 receives a power-saving command through the power-saving command input button 254*a*-1 from a user during a cooling operation, the inputter 254 may control the display 254*b* to display a power-saving rate on a power-saving rate display area 254*b*-1, and control the display 254*b* to display an input of a power-saving command to the power-saving command input display area 254*b*-2.

For example, in a case in which the inputter 254 receives an input to the power-saving command input button 254*a*-1 from a user, the inputter 254 may display a user interface (for example, 5step) representing that a power-saving command is input and a user interface (for example, 80%) representing a power-saving rate. At this time, the inputter 254 may display power-saving rates of 60%, 40%, and 120% sequentially whenever the power-saving command input button 254*a*-1 is pressed. Accordingly, the user may select a power-saving rate of the air conditioner 1 by pressing the power-saving command input button 254*a*-1 until a desired power-saving rate is selected. An order of the power-saving rates is not limited to the above example, and according to embodiments, there may be various orders.

Also, in a case in which a power-saving rate of 100% is selected according to a user input to the power-saving command input button 254*a*-1, the inputter 254 may control the display to no longer display the user interface representing that the power-saving command is input.

As such, the inputter 254 may more easily and intuitively set a power-saving rate by receiving a selection of a power-saving command through a single button, and easily set rapid cooling (power-saving rate of 120%), as well as a power-saving rate. In other words, the inputter 254 may enable a user to set a plurality of power-saving steps and also set rapid cooling through a single button.

Figure 10:
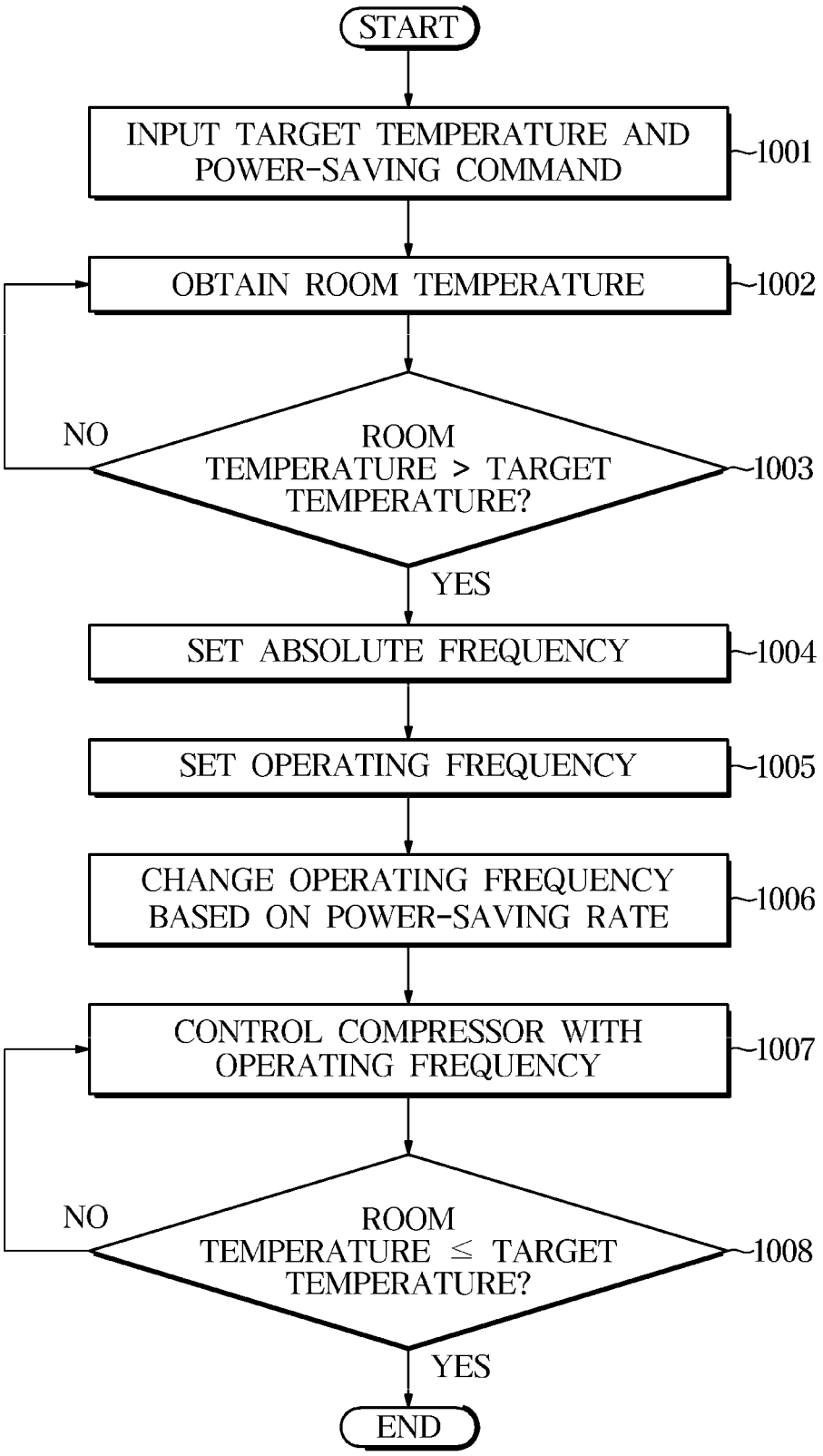
FIG. 10 is a flowchart according to an embodiment.

FIG. 10 is a flowchart according to an embodiment.

Referring to FIG. 10, a user may input target temperature and a power-saving command (1001). The power-saving command may include a power-saving rate.

In a case in which the user's command is input, the air conditioner 1 may obtain room temperature (1002).

Also, in a case in which the room temperature is higher than the target temperature, the air conditioner 1 may drive the compressor to perform cooling (1003).

Also, the air conditioner 1 may set an absolute frequency that is a desired compressor frequency, based on a difference between the room temperature and the target temperature (1004).

Thereafter, the air conditioner 1 may set an operating frequency by changing the absolute frequency in consideration of a driving range of the compressor (1005).

Also, the air conditioner 1 may change the operating frequency by changing the operating frequency based on a power-saving rate included in the power-saving command input by the user (1006).

Meanwhile, the air conditioner 1 that controls the compressor based on the operating frequency may stop driving the compressor in a case in which room temperature reaches the target temperature or the room temperature becomes lower than the target temperature (1007 and 1008).

Meanwhile, the disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a computer-readable recording medium.

The computer-readable recording medium may include all kinds of recording media storing instructions that can be interpreted by a computer. For example, the computer-readable recording medium may be Read Only Memory (ROM), Random Access Memory (RAM), a magnetic tape, a magnetic disc, a flash memory, an optical data storage device, etc.

So far, the disclosed embodiments have been described with reference to the accompanying drawings. It will be understood by one of ordinary skill in the technical art to which the disclosure belongs that the disclosure can be embodied in different forms from the disclosed embodiments without changing the technical spirit and essential features of the present disclosure. Thus, it should be understood that the disclosed embodiments are merely for illustrative purposes and not for limitation purposes.

What is claimed is:

1. An air conditioner comprising:

a compressor;

an inputter configured to receive at least one of a target temperature and a power-saving command from a user, a power-saving command including a plurality of power-saving rates for adjusting an operating frequency of the compressor;

a temperature detector configured to measure a room temperature; and an integrated controller configured to:

set a normal operating frequency of the compressor based on a difference between the received target temperature and the measured room temperature;

control the compressor to drive at the normal operating frequency;

in response to receiving the power-saving command, adjust the normal operating frequency based on a constant value corresponding to one of the plurality of power-saving rates included in the power-saving command; and control the compressor to drive at the adjusted operating frequency.

2. The air conditioner of claim 1, wherein the integrated controller is configured to set an absolute frequency based on the difference between the received target temperature and the measured room temperature, and set the operating frequency by adjusting the absolute frequency based on a driving range of the compressor.

3. The air conditioner of claim 1, wherein the integrated controller is configured to drive the compressor by applying the one of the plurality of power-saving rates to the operating frequency until the driving of the compressor is interrupted or another power-saving command is input after a driving start time of the compressor.

4. The air conditioner of claim 1, further comprising a display, wherein the integrated controller is configured to measure the room temperature from the temperature detector at preset time intervals from a driving start time of the compressor, and output, to the display, a guide message to guide a change of the power-saving command, based on a change of the difference between the received target temperature and the measured room temperature, measured after the driving start time.

5. The air conditioner of claim 1, wherein the integrated controller is configured to turn off the driving of the compressor based on the target temperature being higher than the measured room temperature.

6. The air conditioner of claim 1, wherein the integrated controller is configured to set, based on a another power-saving command input by the user through the inputter after the compressor is driven at the operating frequency, the operating frequency based on the another power-saving command and a difference between the received target temperature and the measured room temperature at a time at which the changed power-saving command is input.

7. The air conditioner of claim 1, wherein the integrated controller is configured to set, based on an automatic power-saving command input by the user through the inputter, an optimization frequency based on a difference between a changed room temperature and the received target temperature, and drive the compressor at the set optimization frequency.

8. The air conditioner of claim 1, further comprising a display, wherein the integrated controller is configured to identify an accumulated driving time of the compressor, and output an error message to the display based on the accumulated driving time exceeding a preset time.

9. A method for controlling an air conditioner having a compressor, an integrated controller to control the compressor, and a display, comprising:

receiving at least one of a target temperature and a power-saving command, the power-saving command including a plurality of power-saving rates for adjusting an operating frequency of the compressor;

measuring a room temperature;

setting a normal operating frequency of the compressor based on a difference between the received target temperature and the measured room temperature;

controlling, by the integrated controller, the compressor to drive at the normal operating frequency;

in response to receiving the power-saving command, adjusting the normal operating frequency based on a constant value corresponding to one of the plurality of the power-saving rates included in the power-saving command; and controlling the compressor to drive at the adjusted operating frequency.

10. The method of claim 9, further comprising setting an absolute frequency based on the difference between the received target temperature and the measured room temperature, wherein the setting of the operating frequency of the compressor comprises setting the operating frequency by changing the absolute frequency based on a driving range of the compressor.

11. The method of claim 9, further comprising driving the compressor by applying the one of the plurality of power-saving rates to the operating frequency until the driving of the compressor is interrupted or another power-saving command is received after a driving start time of the compressor.

12. The method of claim 9, wherein the measuring of the room temperature comprises measuring the room temperature at preset time intervals from a driving start time of the compressor, and the method further comprising outputting, to a display of the air conditioner, a guide message to guide a change of the power-saving command, based on a change of a difference between the received target temperature and the measured room temperature measured after the driving start time.

13. The method of claim 9, further comprising turning off the driving of the compressor based on the target temperature being higher than the measured room temperature.

* * * * *